US005697538A

United States Patent [19]

Goldenberg et al.

[11] Patent Number: 5,697,538

[45] Date of Patent: Dec. 16, 1997

[54] HOLSTER FOR A PORTABLE COMMUNICATION DEVICE

[75] Inventors: Michael P. Goldenberg, Delray; Michael J. Hartigan, Boca Raton, both of Fla.

[73] Assignee: Motorola, Inc., Schaumburg, Ill.

[21] Appl. No.: 740,937

[22] Filed: Nov. 5, 1996

[51] Int. Cl.[6] ..... A45F 5/02

[52] U.S. Cl. ..... 224/676; 224/245; 224/930

[58] Field of Search ..... 224/679, 676, 224/930, 246, 245, 242, 163

[56] References Cited

U.S. PATENT DOCUMENTS

D. 345,053 3/1994 Gomez et al. .
D. 348,981 7/1994 Dill .
D. 351,280 10/1994 Pennington et al. .
4,299,344 11/1981 Yamashita et al ..... 224/930
4,534,063 8/1985 Krumin et al. ..... 224/163 X
4,770,328 9/1988 Dickhudt et al. ..... 224/930
5,097,997 3/1992 Kipnis et al. ..... 224/930
5,261,583 11/1993 Long et al. ..... 224/245
5,452,829 9/1995 King et al. .

*Primary Examiner*—Renee S. Luebke
*Attorney, Agent, or Firm*—John H. Moore

[57] ABSTRACT

A one piece holster 10 for a PCD (Personal Communication Device) 24 has a back wall 14, sidewalls 18 and a bottom ledge 20 formed to receive a PCD either by lateral or vertical insertion. A snap fit feature and a locking mechanism 38 hold the PCD securely within the holster 10. A clip 56 is integrally formed with the back wall 14 for supporting the holster on a user's clothing.

4 Claims, 4 Drawing Sheets

HOLSTER FOR A PORTABLE COMMUNICATION DEVICE

FIELD OF THE INVENTION

This invention is directed to a holster for carrying a portable communication device.

BACKGROUND OF THE INVENTION

Holsters are commonly used to carry PCD's (Portable Communication Devices) such as pagers and other forms of messaging products. A typical holster includes a clip that allows a user to carry the holster on the user's belt or on another article of clothing.

Recently, some PCD's have become larger and heavier as they become able to perform more tasks for a user, but their holsters have not been well adapted to such size changes. Consequently, the holsters do not hold these larger PCD's snugly against the user's body. In some cases, the holster bounces against the user's body as the user walks, making it uncomfortable to carry this larger type of PCD.

Some PCD's come with a cover that can be flipped open to reveal a keyboard or other controls. Conventional holsters can hold such a PCD, but they do not permit the PCD's cover to be opened while it resides in the holster. Consequently, the PCD cannot be manipulated by the user while it is in its holster. It would be desirable if a covered PCD could be opened while in its holster, but only if the PCD were held securely enough in the holster to avoid accidental release.

DESCRIPTION OF THE PREFERRED EMBODIMENT

Figure 1:
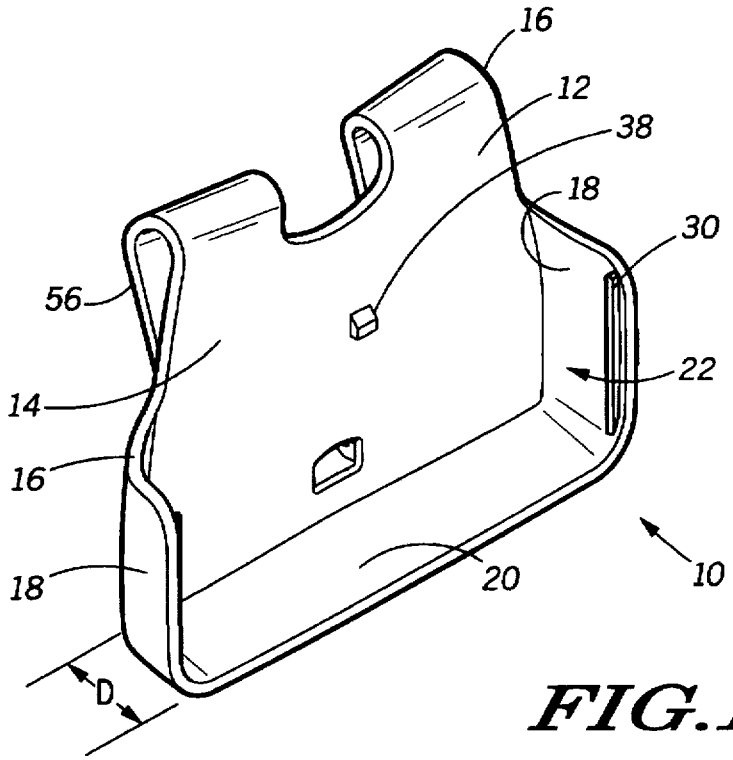
FIG. 1 is a front perspective view of a holster according to the invention.
Figure 2:
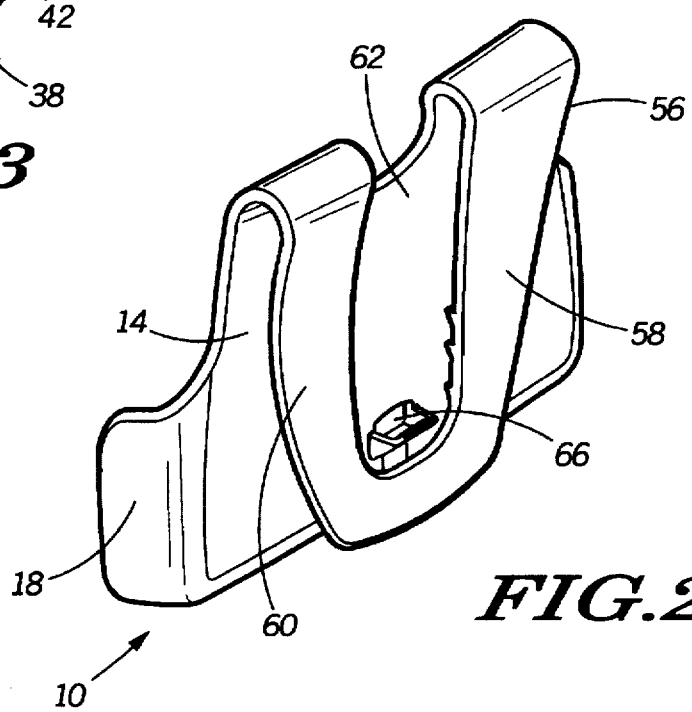
FIG. 2 is a rear perspective view of the holster shown in FIG. 1.

FIGS. 1 and 2 show a holster 10 that is constructed in accordance with the invention to overcome the above-noted deficiencies of conventional holsters. The illustrated holster is preferably a one-piece housing 12 that has a substantially planar back wall 14 that extends for substantially the full height of the holster. This back wall has outer edges 16 that extend downwardly and outwardly to meet a pair of sidewalls 18 that are formed integrally with the back wall 14. The sidewalls 18 extend substantially perpendicularly from the back wall 14 and are substantially parallel to each other. The vertical height of the sidewalls 18 (as viewed in FIG. 1) is approximately one-half the overall height of the holster. As described in more detail later, the sidewalls 18 are outwardly deflectable for receiving and holding a PCD.

The depth D of the sidewalls 18 can be less than the depth of a PCD that is to be held by the holster 10, thus permitting the held PCD to extend beyond the furthest lateral reach of the sidewalls 18. This is particularly advantageous for a PCD that has a cover and/or controls that are to be accessible to a user while the PCD is in the holster.

The sidewalls 18 and the back wall 14 merge at the bottom of the holster to form an integral bottom ledge 20 located between the sidewalls and extending substantially perpendicularly from the back wall 14. The bottom ledge 20 preferably extends laterally from the back wall 14 by the distance D so that the bottom ledge 20 has the same depth as the sidewalls 18.

Figure 6:
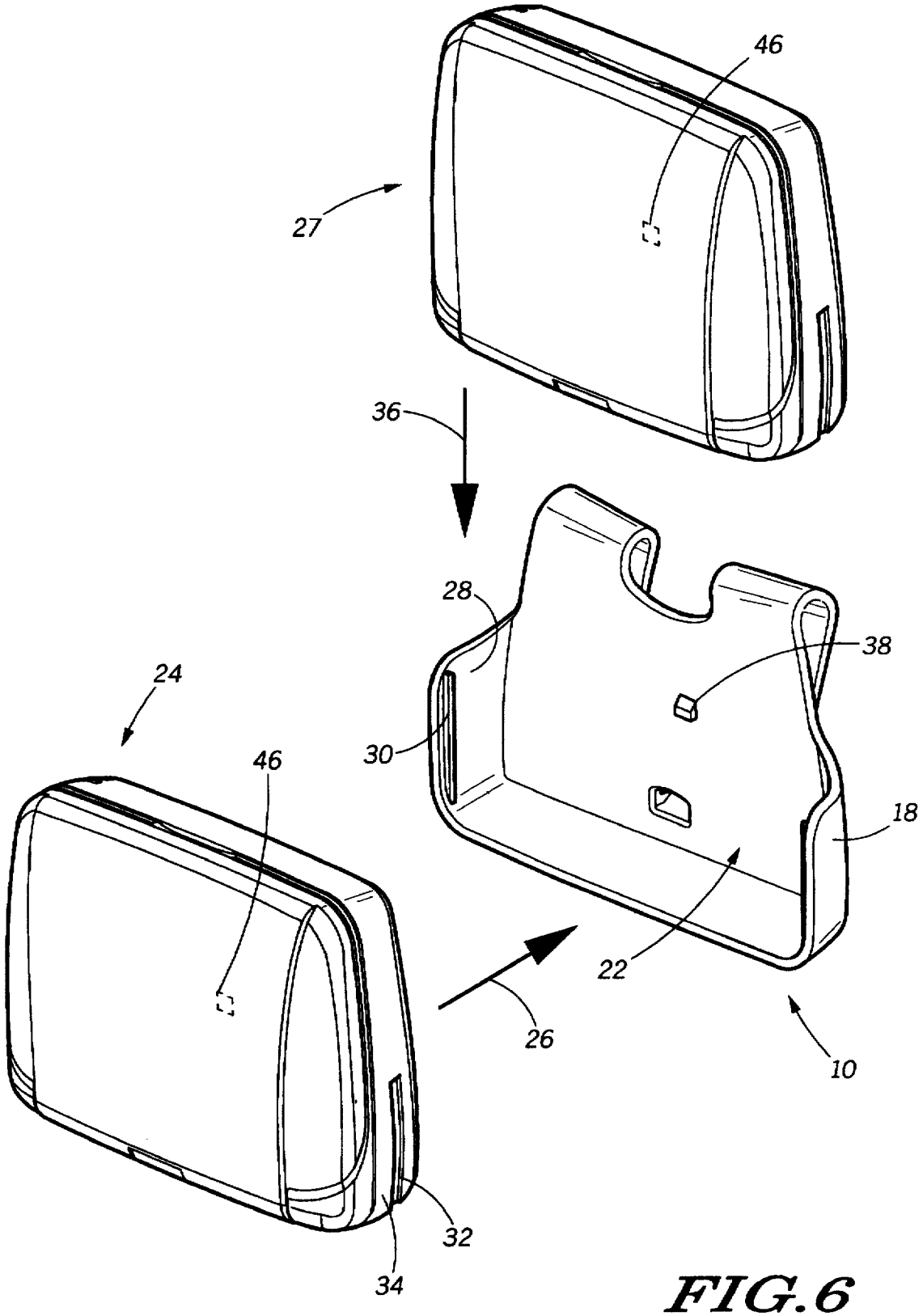
FIG. 6 shows the holster and how a PCD can be inserted into the holster, either vertically or laterally.
Figure 7:
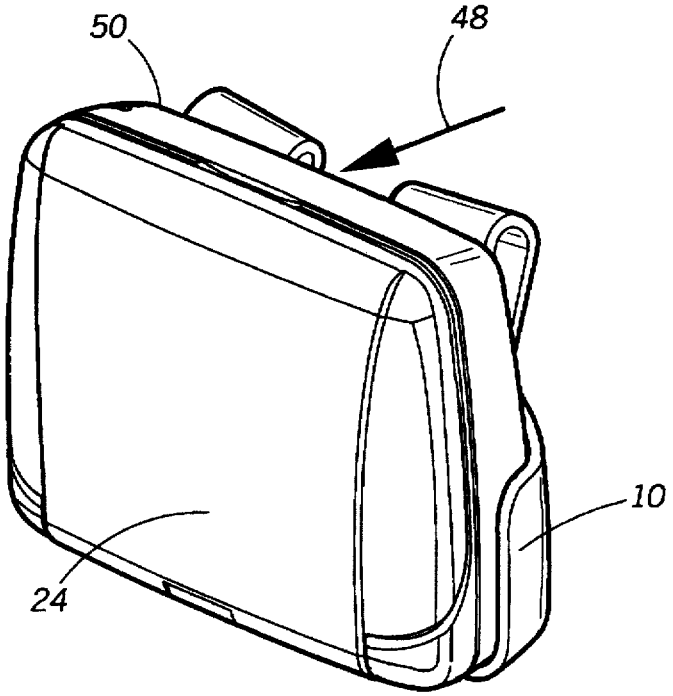
FIG. 7 shows a PCP carried in the holster.

The bottom ledge 20 and the sidewalls 18 are sized to collectively define a U-shaped opening 22 in the housing 16 that constitutes a lateral entry into which a PCD fits snugly. Referring briefly to FIG. 6, a PCD 24 is shown positioned for lateral entry into the holster 10. The user of the PCD 24 moves it in the direction of the arrow 26 so that the PCD 24 enters the opening 22 where it is held by the holster. Each of the sidewalls 18 has an inner surface 28 that engages the PCD and forms a snap fit therewith. FIG. 7 shows the PCD fully seated in the holster 10.

Referring again to FIGS. 1 and 6, the inner surface of each sidewall 18 carries an inwardly facing protrusion 30 that is adapted to engage a mating depression in a PCD for effecting a snap fit with the PCD and for prohibiting lateral removal of a PCD which has been seated in the holster. In the illustrated example, the PCD 24 (FIG. 6) has a slot or groove 32 formed in each of its sidewalls 34. To mate with these slots, the protrusions 30 in the holster's sidewalls 18 are in the form of rails. When these rails mate with the slots 32 in the PCD, the user feels a definite detent and hears an audible snap that assures him that the PCD is securely seated in the holster and cannot be inadvertently removed by lateral force on the PCD in a direction opposite to the arrow 26 (FIG. 6).

The illustrated arrangement also advantageously permits a PCD to be inserted into the holster vertically. FIG. 6 shows another PCD 27 (identical to PCD 24) positioned to be inserted into the holster 10 by moving it vertically in the direction of an arrow 36. This vertical insertion of the PCD results in it being held as securely as provided by lateral insertion; but with vertical insertion the rails do not provide the user with such a definite snap fit sensation because the rails slide into the grooves 32 instead of snapping into them. There is, however, a locking mechanism built into the holster 10 that provides a somewhat similar snap fit sensation when the PCD is inserted vertically. This mechanism is shown in FIGS. 1 and 3.

In FIG. 1, the back wall 14 carries a locking protrusion 38 that extends toward the lateral entry formed by opening 22. The purpose of the locking protrusion 38 is to engage a mating depression in an inserted PCD to releasably lock the PCD within the holster. See FIG. 6 which shows the location of a mating depression 46 formed in the rear wall of the PCD 24.

Figure 3:
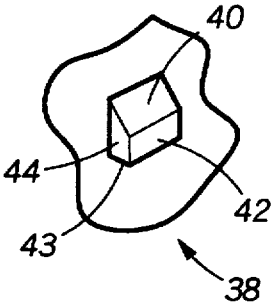
FIG. 3 is an enlarged view of a locking protrusion carried by the back wall of the holster.

Referring to FIG. 3, the locking protrusion 38 has an upper inclined surface 40 that meets a substantially vertical front surface 42. A bottom surface 43 is substantially horizontal, and side surfaces 44 are substantially vertical.

When a PCD is inserted into the holster 10, either laterally or vertically, the bottom surface 43 of the locking protrusion 38 engages a mating horizontal surface in the PCD's depression 46. Consequently, the PCD is locked into the holster to prevent accidental removal. FIG. 7 shows the PCD 24 locked into the holster 10.

To remove the PCD 24 from the holster, the user pushes against a top portion 50 of the PCD in the direction indicated by arrow 48 (FIG. 7), creating a small space between the top of the holster and the top of the PCD. In response, the bottom portion of the PCD exerts force against the bottom of the holster's back wall 14. The back wall 14 is sufficiently flexible so that the resultant force exerted by the PCD causes the back wall to flex and release the locking protrusion 38 from the depression 46. The PCD can now by lifted from the holster.

Figure 8:
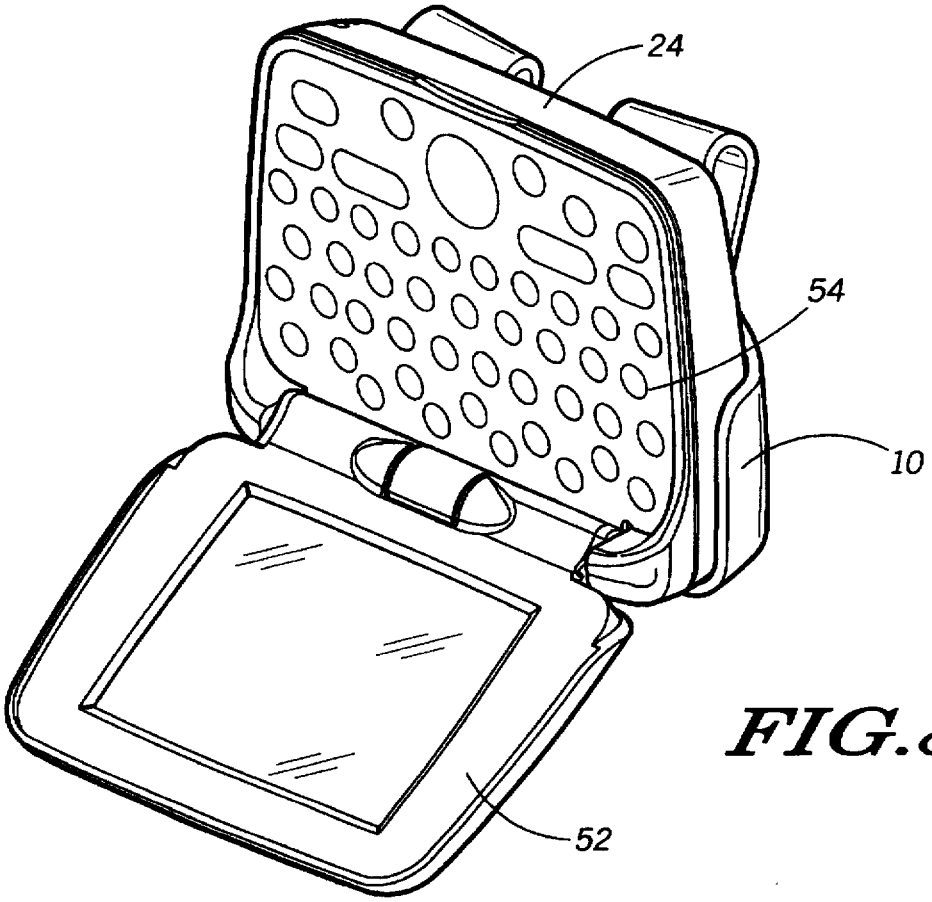
FIG. 8 shows a PCD in the holster and with the PCD's cover opened.

Because the holster 10 provides an unobstructed lateral entry for a PCD, it can hold a covered PCD securely and permit the cover to be opened for use of the PCD. As shown in FIGS. 7 and 8, the PCD 24 has a flip cover 52. When the cover 52 is closed, the PCD rests in the holster as shown in FIG. 7. Because the holster does not require walls that enclose the PCD on all sides, the cover 52 can be opened as shown in FIG. 8. Even for PCD's that do not have a cover, the holster 10 is advantageous because it allows the user to access the PCD's controls 54 which could otherwise be covered by a wall of a conventional holster. It is the snap fit action and the locking mechanism of the holster 10 that ensure that the PCD is held securely in the holster without the need for walls that completely enclose the PCD.

The holster preferably includes a supporting mechanism for supporting the holster on a user's clothing or other article. Referring to FIG. 2, the illustrated supporting mechanism for the holster 10 is in the form of a clip 56 coupled to the back wall 14 for supporting the holster on a user's clothing. The clip 56 is preferably an integral part of the housing 16, and is formed by folding back the housing 16 over the back wall 14. The clip 56 includes a pair of flexible arms 58, 60 that extend downwardly along a rear surface of the back wall 14. The lower ends of the arms are joined together as shown, with an opening 62 between them.

The clip 56 is nearly as wide as the back wall 14 and its arms 58, 60 begin at the top of the holster. This causes the holster and PCD to be held in a stable position against the user's body, even with a larger and more massive PCD. The bouncing that sometimes occurs with conventional holsters and clips is substantially eliminated.

Figure 4:
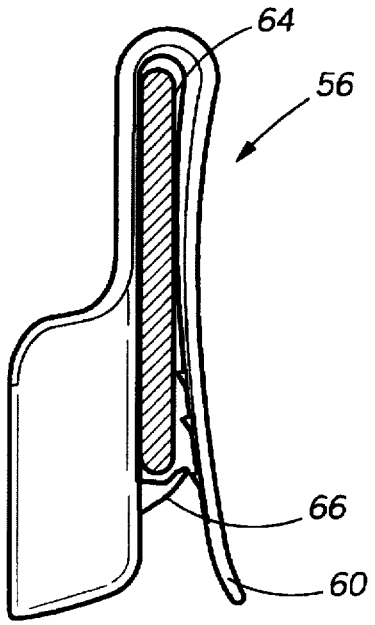
FIG. 4 is a side view of the holster's belt clip, showing the clip engaged with a belt.
Figure 5:
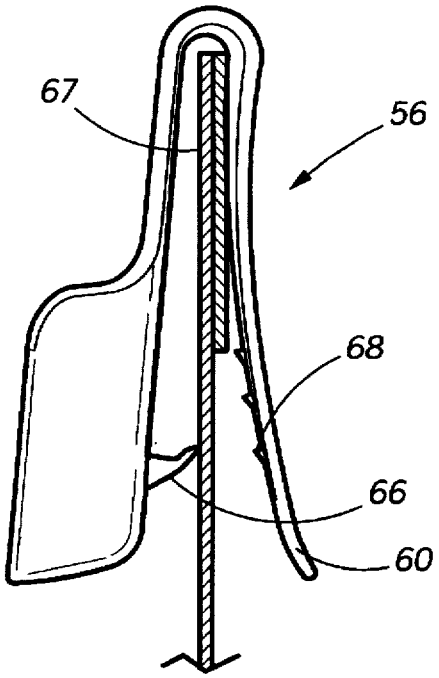
FIG. 5 is another side view of the holster's belt clip, showing the clip engaged with clothing.

The belt clip attaches to a user's clothing as shown in FIGS. 4 and 5. In FIG. 4, the clip's arms 58, 60 are flexed outwardly and slipped over the user's belt 64. The holster is held securely on the belt by a rearwardly extending protrusion 66, carried on the back wall 14, that acts as a belt hook. In this position, the arms 58, 60 of the clip press against the belt, and the protrusion 66 locks the clip in place. To remove the holster from the belt, the user pushes the arms 58, 60 away from the belt so that the belt is no longer captured by the protrusion 66, and then the holster can be lifted off the belt.

In FIG. 5, the clip 56 is shown as attached to the waist hem 67 of a pair of pants. Barbs 68 formed on an inner surface of arms 58, 60 bear on the hem 67 and press it against the belt locking protrusion 66. In this manner, the holster is held securely on the hem 67 until the user removes it.

To provide a low cost holster, and to provide the flexibility that various components of the holster rely on, the holster is preferably constructed of a polycarbonate having a thickness of approximately two millimeters.

Although the invention has been described in terms of a preferred embodiment, it will be obvious to those skilled in the art that many alterations and variations may be made without departing from the invention. Accordingly, it is intended that all such alterations and variations be considered within the spirit and scope of the invention as defined by the appended claims.

What is claimed is:

1. A holster for a portable communication device, comprising:

a housing having a substantially planar back wall, a pair of substantially parallel sidewalls extending substantially perpendicularly from the back wall, and a bottom ledge located between the sidewalls and extending substantially perpendicularly from the back wall, the bottom ledge and the side walls being sized to collectively define a U-shaped opening that constitutes a lateral entry into which a portable communication device fits snugly, and the sidewalls each having an inner surface for engaging a portable communication device and forming a snap fit therewith, wherein the back wall carries a protrusion that extends toward the lateral entry for engaging an inserted portable communication device to releasably lock the portable communication device within the holster, and wherein the back wall is sufficiently flexible so that, when a portable communication device is held within the U-shaped opening, lateral outward force that urges the portable communication device away from the back wall also causes the back wall to flex such that the protrusion releases from the portable communication device, thereby permitting the portable communication device to be lifted from the holster.

2. A holster for a portable communication device, comprising:

a one piece housing having a substantially planar back wall, a pair of substantially parallel sidewalls extending substantially perpendicularly from the back wall, and a bottom ledge located between the sidewalls and extending substantially perpendicularly from the back wall, the bottom ledge and the side walls being sized to collectively define a U-shaped opening that constitutes a lateral entry into which a portable communication device fits snugly, the sidewalls each having an inner surface for engaging a portable communication device and forming a snap fit therewith, and a clip integrally formed with the housing and coupled to the back wall for supporting the holster on a user's clothing, wherein the clip is in the form of a pair of arms extending downwardly along a rear surface of the back wall, the arms being joined together at a lower end and having an opening between the arms.

3. A holster as set forth in claims 2 wherein the rear surface of the back wall includes a rearwardly extending protrusion forming a belt hook.

4. A holster for a portable communication device, comprising:

a housing having a substantially planar back wall, a pair of substantially parallel, deflectable sidewalls extending substantially perpendicularly from the back wall, and a bottom ledge located between the sidewalls and extending substantially perpendicularly from the back wall, wherein the bottom ledge and the side walls collectively form a U-shaped opening that permits lateral and vertical insertion of the portable communication device, wherein the sidewalls each have an inner surface with an inwardly facing rail, wherein the sidewalls deflect outwardly under pressure of a portable communication device being inserted laterally, and the rails are adapted to engage the portable communication device for effecting a snap fit therewith and for prohibiting lateral removal of the portable communication device; wherein the back wall carries a locking protrusion for engaging an inserted portable communication device to releasably lock the portable communication device within the holster;

wherein the back wall is sufficiently flexible so that, when a portable communication device is held within the U-shaped opening, lateral outward force that urges the portable communication device away from the back wall also causes the back wall to flex such that the locking protrusion releases from the portable communication device, thereby permitting the portable communication device to be lifted from the holster; and a clip coupled to the back wall for supporting the holster on a user's clothing.

* * * * *